US009662773B2

(12) United States Patent
Hsieh

(10) Patent No.: US 9,662,773 B2
(45) **Date of Patent: *May 30, 2017**

(54) BIDIRECTIONAL RATCHET STRUCTURE, BIDIRECTIONAL RATCHET WRENCH AND METHOD FOR CHANGING A DIRECTION THEREOF

(71) Applicant: KABO TOOL COMPANY, Taichung (TW)

(72) Inventor: Chih-Ching Hsieh, Taichung (TW)

(73) Assignee: KABO TOOL COMPANY, Taichung (TW)

( * ) Notice: Subject to any disclaimer, the term of this patent is extended or adjusted under 35 U.S.C. 154(b) by 326 days.

This patent is subject to a terminal disclaimer.

(21) Appl. No.: 14/138,112

(22) Filed: Dec. 22, 2013

(65) Prior Publication Data

US 2014/0224078 A1 Aug. 14, 2014

(30) Foreign Application Priority Data

Feb. 8, 2013 (TW) ..... 102105433 A

(51) Int. Cl.
*B25B 13/46* (2006.01)

(52) U.S. Cl.
CPC ..... *B25B 13/465* (2013.01); *Y10T 74/214* (2015.01)

(58) Field of Classification Search
CPC ..... B25B 13/46; B25B 13/465; B25B 15/04; Y10T 74/214
USPC ..... 81/60, 62
See application file for complete search history.

(56) References Cited

U.S. PATENT DOCUMENTS 2,744,432 A * 5/1956 Rueb ..... B25B 13/465 81/62
6,976,409 B2 * 12/2005 Shu ..... B25B 13/465 81/62
7,055,410 B2 * 6/2006 Hu ..... B25B 15/04 81/60
7,066,054 B2 * 6/2006 Liu ..... B25B 13/465 81/62
9,186,781 B2 * 11/2015 Wang ..... B25B 13/465

* cited by examiner

*Primary Examiner* — Hadi Shakeri
(74) *Attorney, Agent, or Firm* — CKC & Partners Co., Ltd.

(57) ABSTRACT

A bidirectional ratchet structure includes a base, a first pawl element, a second pawl element, two reset elements, a direction controller and a driving element. The first pawl element, the second pawl element, the direction controller and the driving element are pivotally disposed at the base. The first pawl element includes a first engaging portion. The second pawl element includes a second engaging portion. The first engaging portion and the second engaging portion are pushed to protrude from the base alternatively. The two reset elements are for pushing the first engaging portion and the second engaging portion to protrude from the base respectively. The first pawl element and the second pawl element are surrounded by the direction controller and the driving element. The direction controller is for pressing the first pawl element or the second pawl element toward the base.

16 Claims, 5 Drawing Sheets

BIDIRECTIONAL RATCHET STRUCTURE, BIDIRECTIONAL RATCHET WRENCH AND METHOD FOR CHANGING A DIRECTION THEREOF

RELATED APPLICATIONS

This application claims priority to Taiwan Application Serial Number 102105433, filed Feb. 8, 2013, which is herein incorporated by reference.

BACKGROUND

Technical Field

The present disclosure relates to a ratchet structure, a ratchet wrench and a method for changing a direction thereof. More particularly, the present disclosure relates to a bidirectional ratchet structure, a bidirectional ratchet wrench and a method for changing a direction thereof.

Description of Related Art

A ratchet wrench is a kind of widely used hand tool. The ratchet wrench allows the user to tighten or loosen a screw by using a back-and-forth motion without removing the ratchet wrench from the screw. Therefore, the ratchet wrench simplifies the tightening and loosening process and thus enhances the work efficiency apparently. Furthermore, the ratchet wrench can be used in a confined space. As a result, the ratchet wrench has become an indispensable product nowadays.

A conventional bidirectional ratchet wrench is provided, which allows a user to change a direction thereof via a switching button. However, the conventional bidirectional ratchet wrench has a lot of disadvantages. For example, the structure of the bidirectional ratchet wrench is not stable due to a bidirectional ratchet structure. Furthermore, the conventional bidirectional ratchet structure is usually controlled by a small switching button, which is unreliable, easily damaged, and difficulty operated. As a result, a conventional bidirectional ratchet wrench has a certain degree of operation inconvenience.

SUMMARY

According to one aspect of the present disclosure, a bidirectional ratchet structure includes a base, a first pawl element, a second pawl element, two reset elements, a direction controller and a driving element. The first pawl element includes a first engaging portion, and is pivotally disposed at the base. The second pawl element includes a second engaging portion, and is pivotally disposed at the base. The first engaging portion of the first pawl element and the second engaging portion of the second pawl element are pushed to protrude from the base alternatively, fine of the reset elements disposed between the base and the first pawl element is for pushing the first engaging portion of the first pawl element to protrude from the base, and the other one of the reset elements disposed between the base and the second pawl element is for pushing the second engaging portion of the second pawl element to protrude from the base. The direction controller is pivotally and coaxially disposed at the base. The first pawl element and the second pawl element are surrounded by the direction controller. The direction controller includes a pressing portion for pressing the first pawl element or the second pawl element toward the base. The driving element is pivotally and coaxially disposed at the base. The first pawl element and the second pawl element are rotatably surrounded by the driving element. The driving element includes an inner tooth portion, and the inner tooth portion engages with the first engaging portion of the first pawl element or the second engaging portion of the second pawl element which is pushed to protrude from the base.

According to another aspect of the present disclosure, a bidirectional ratchet wrench includes a handle and a bidirectional ratchet structure. The bidirectional ratchet structure includes a base, a first pawl element, a second pawl element, two reset elements, a direction controller and a driving element. The handle is for being held by a user. The base is connected with the handle. The first pawl element includes a first engaging portion, and is pivotally disposed at the base. The second pawl element includes a second engaging portion, and is pivotally disposed at the base. The first engaging portion of the first pawl element and the second engaging portion of the second pawl element are pushed to protrude from the base alternatively. One of the reset elements disposed between the base and the first pawl element is for pushing the first engaging portion of the first pawl element to protrude from the base, and the other one of the reset elements disposed between the base and the second pawl element is for pushing the second engaging portion of the second pawl element to protrude from the base. The direction controller is pivotally and coaxially disposed at the base. The first pawl element and the second pawl element are surrounded by the direction controller. The direction controller includes a pressing portion for pressing the first pawl element or the second pawl element toward the base. The driving element is pivotally and coaxially disposed at the base. The first pawl element and the second pawl element are rotatably surrounded by the driving element. The driving element includes an inner tooth portion, and the inner tooth portion engages with the first engaging portion of the first pawl element or the second engaging portion of the second pawl element which is pushed to protrude from the base.

According to yet another aspect of the present disclosure, a method for changing a direction of the aforementioned bidirectional ratchet structure includes steps as follows. The first pawl element and the second pawl element are disposed pivotally at the base. Each of the first pawl element and the second pawl element is provided with a reset force for protruding from the base. The first pawl element is pressed toward the base. The second pawl element is pushed to protrude from the base via the reset force. The inner tooth portion of the driving element engages with the second pawl element so as to make the driving element rotate unidirectionally.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
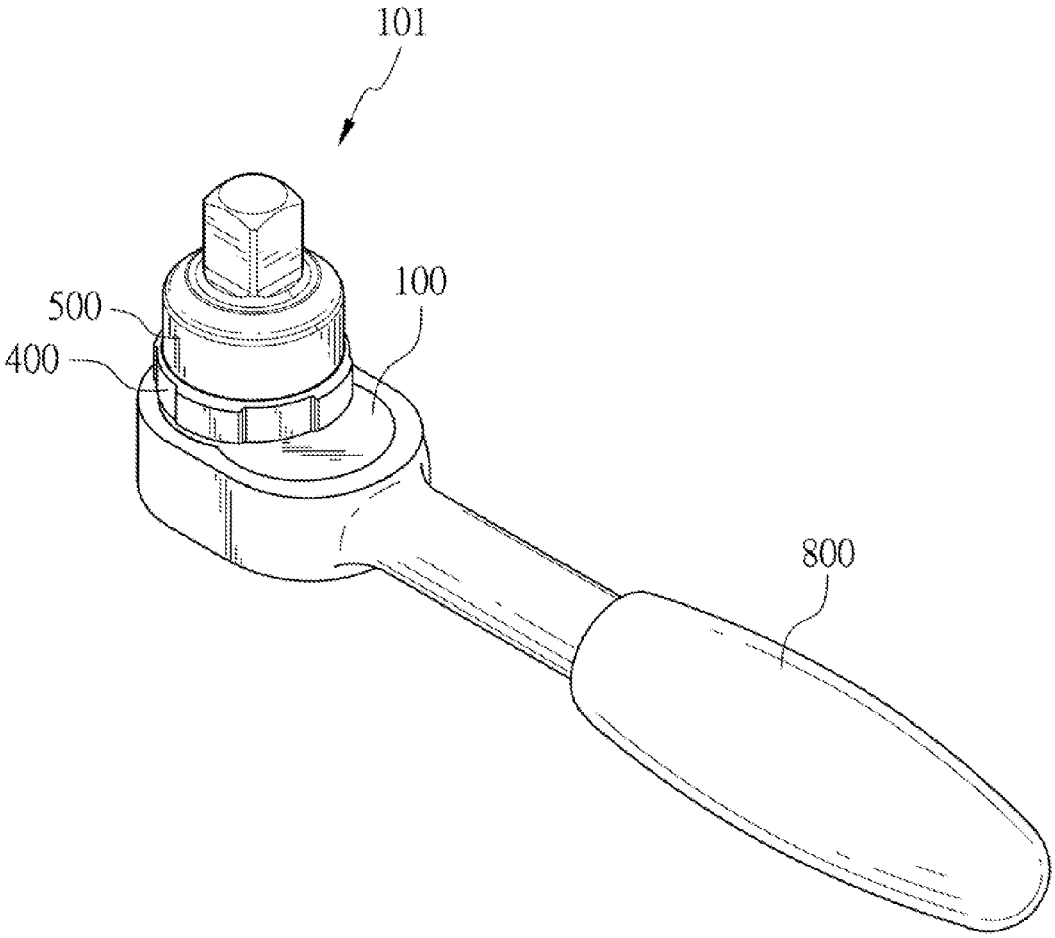
FIG. 1 is a three dimensional view of a bidirectional ratchet wrench according to one embodiment of the present disclosure.
Figure 2:
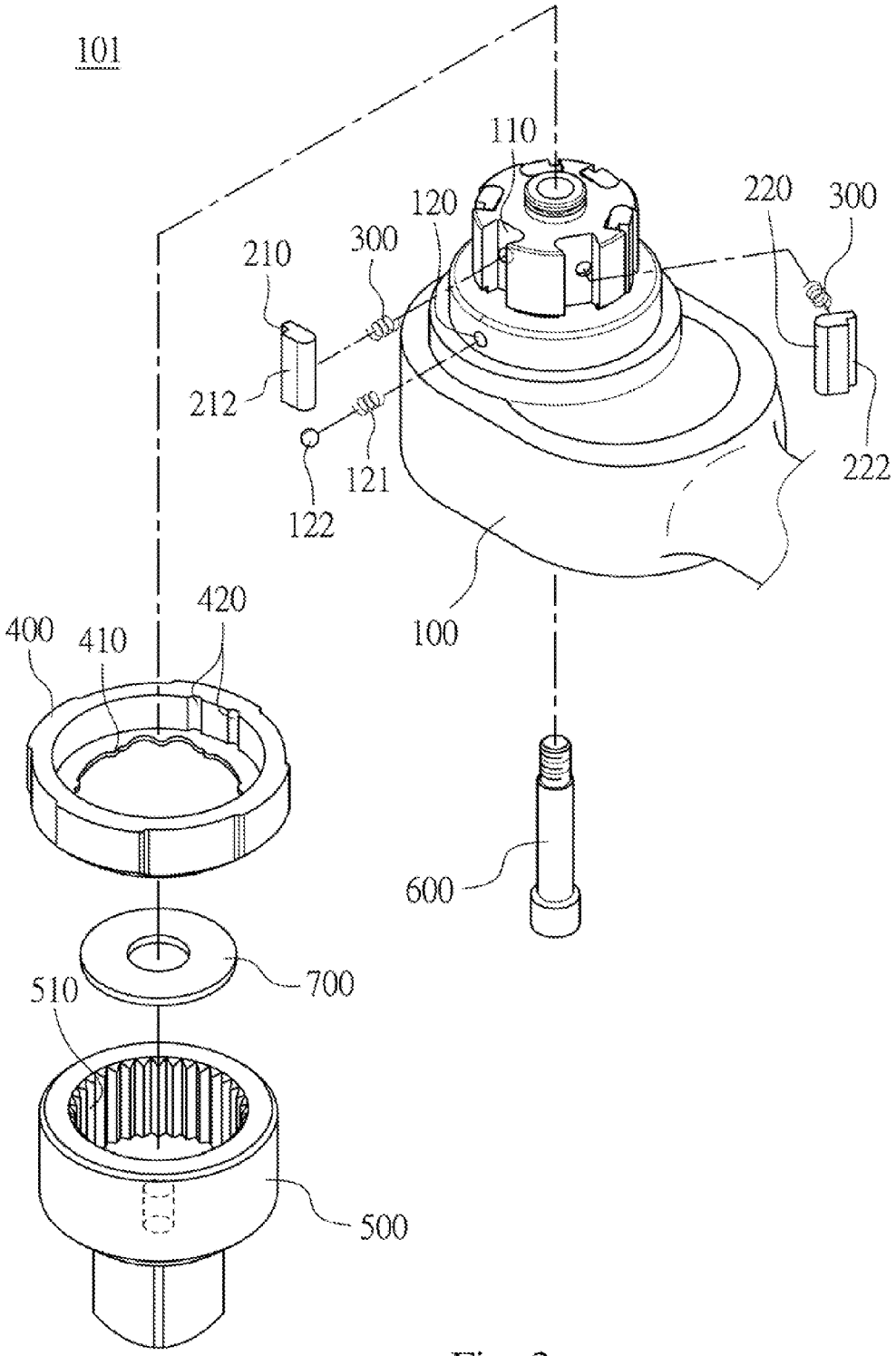
FIG. 2 is an exploded view of a bidirectional ratchet structure as illustrated in FIG.
Figure 3:
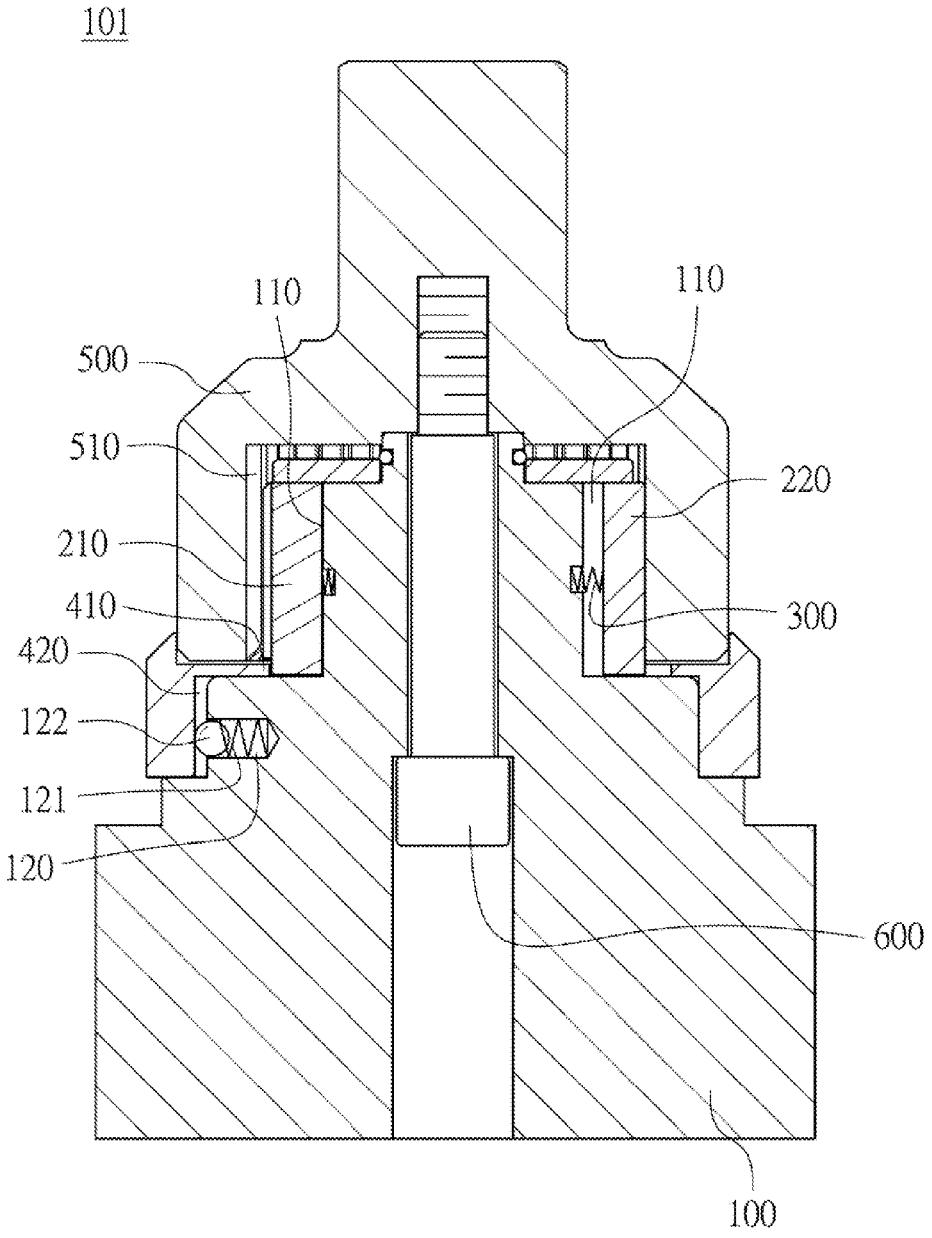
FIG. 3 is a cross-sectional view of the bidirectional ratchet structure as illustrated in FIG. 1.
Figure 4:
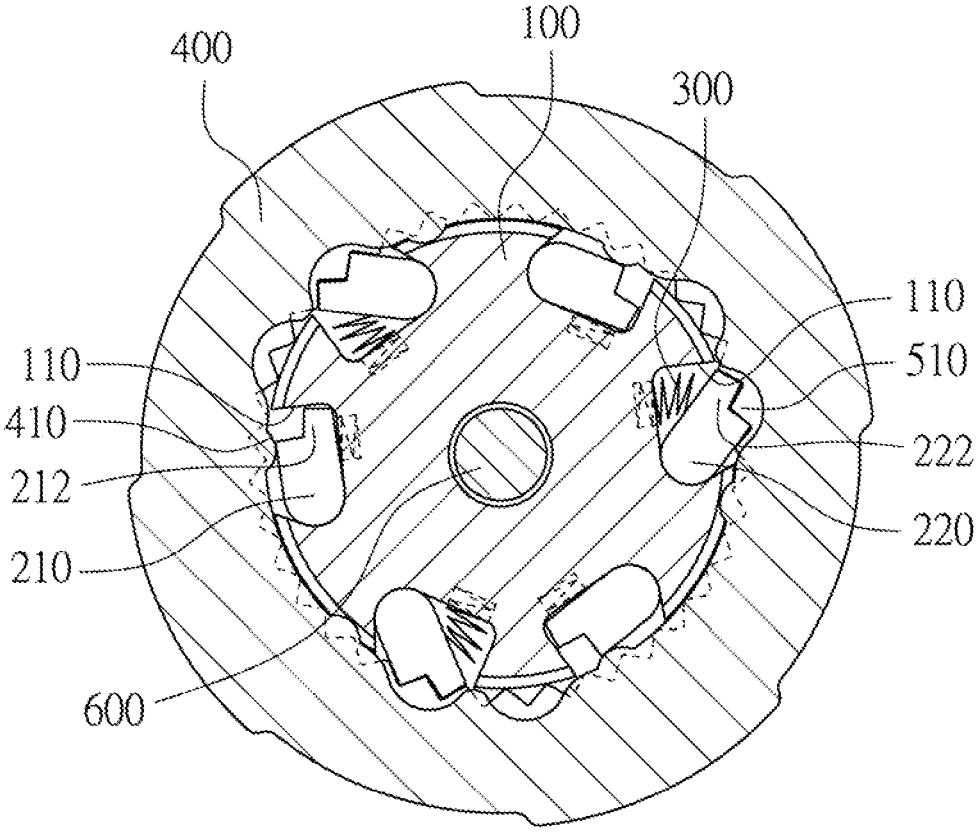
FIG. 4 is a schematic view showing a direction controller pressing three first pawl elements toward a base as illustrated in FIG. 2.

FIG. 1 is a three dimensional view of a bidirectional ratchet wrench according to one embodiment of the present disclosure. FIG. 2 is an exploded view of a bidirectional ratchet structure 101 as illustrated in FIG. 1. FIG. 3 is a cross-sectional view of the bidirectional ratchet structure 101 as illustrated in FIG. 1. FIG. 4 is a schematic view showing a direction controller 400 pressing three first pawl elements 210 toward a base 100 as illustrated in FIG. 2. In FIG. 1 the bidirectional ratchet wrench includes a bidirectional ratchet structure 101 and a handle 800. The bidirectional ratchet structure 101 is connected with the handle 800. The handle 800 is for being held by a user. The bidirectional ratchet structure 101 is fixedly connected with an end of the handle 800, and the handle 800 is but not limited to be formed in an H shape. In other embodiment, the bidirectional ratchet structure 101 can be connected with a middle of the handle 800 or pivotally connected with the handle 800 for operation convenient.

In FIG. 2, the bidirectional ratchet structure 101 includes the base 100, the three first pawl elements 210 (only one of the three first pawl elements 210 is depicted in FIG. 2), three second pawl elements 220 (only one of the second pawl elements 220 is depicted in FIG. 2), six reset elements 300 only two of the six reset elements 300 are depicted in FIG. 2), the direction controller 400, a driving element 500, a pivoting element 600 and a gasket 700. Only one of the first pawl elements 210, only one of the second pawl elements 220 and only two of the six reset elements 300 are depicted in FIG. 2 for the sake of clarity and conciseness. The base 100 is connected with the handle 800. The base 100 has six recess portions 110. The three first pawl elements 210 and the three second pawl elements 220 are alternately accommodated in the recess portions 110. A number of the first pawl elements 210 can be but not limited to three. A number the second pawl elements 220 can be but not limited to three. A number of the recess portions 110 depends on a sum of the number of the first pawl elements 210 and the number of the second pawl elements 220.

All the first pawl elements 210 are pushed to protrude from the base 100 or pressed toward the base 100 at the same time. All the second pawl elements 220 are pushed to protrude from the base 100 or pressed toward the base 100 at the same time. The first pawl elements 210 and the second pawl elements 220 are pushed to protrude from the base 100 alternatively, and the first pawl elements 210 and the second pawl elements 220 are for changing a rotating direction of the bidirectional ratchet structure 101.

One of the first pawl elements 210 and one of the reset elements 300 are accommodated in one of the recess portions 110. The first pawl element 210 includes a first engaging portion 212 and is pivotally disposed at the base 100. The reset element 300 disposed between the base 100 and the first pawl element 210 is for pushing the first engaging portion 212 of the first pawl element 210 to protrude from the base 100. One the second pawl elements 220 and another one of the reset elements 300 are accommodated in another one of the recess portions 110. The second pawl element 220 includes a second engaging portion 222 and is pivotally disposed at the base 100. The reset element 300 disposed between the base 100 and the second pawl element 220 is for pushing the second engaging portion 222 of the second pawl element 220 to protrude from the base 100. The first engaging portion 212 of the first pawl element 210 and the second engaging portion 222 of the second pawl element 220 are pushed to protrude from the base 100 alternatively. A number of the reset element 300 depend on the sum of the number of the first pawl elements 210 and the number of the second pawl elements 220.

The direction controller 400 is pivotally and coaxially disposed at the base 100, and the first pawl elements 210 and the second pawl elements 220 are surrounded by the direction controller 400. The direction controller 400 includes six pressing portions 410 for pressing the first pawl elements 210 or the second pawl elements 220 toward the base 100. The driving element 500 is pivotally and coaxially disposed at the base 100, and the first pawl elements 210 and the second pawl elements 220 are rotatably surrounded by the driving element 500. The driving element 500 includes an inner tooth portion 510, and the inner tooth portion 510 engages with the first engaging portions 212 of the first pawl elements 210 or the second engaging portions 222 of the second pawl elements 220 which are pushed to produce from the base 100.

The pivoting element 600 pivotally and coaxially connects the base 100 and the driving element 500. The gasket 700 is disposed between the base 100 and the driving element 500.

The reset element 300 can be a spring, an elastic sheet or an elastomer. The driving element 500 can further includes a driving head disposed at an end of the driving element 500, and the driving head is a square wrench head, a hex wrench head, a socket wrench head or an adapter head for wrenches.

In FIG. 2 and FIG. 3, the base 100 of the bidirectional ratchet structure 101 can further include a first position portion 120. The first position portion 120 is for accommodating an elastic element 121 and an engaging element 122. The direction controller 400 can further includes a second position portion 420 corresponding to the engaging element 122. When the direction controller 400 is rotated to a predetermined position for pressing the first pawl elements 210 or the second pawl elements 220, the engaging element 122 is pushed by the elastic element 121 to press against the second position portion 420 so as to position the direction controller 400 relative to the base 100. Accordingly, an undesired relative movement between the direction controller 400 and the base 100 during applying the bidirectional ratchet wrench to a workpiece can be avoided. The elastic element 121 can be a spring, and the engaging element 122 can be a round ball or a steel ball. The second position portion 420 can be formed in a recess for receiving the engaging element 122.

In FIG. 3 and FIG. 4, the first engaging portion 212 of the first pawl elements 210 are pressed toward the base 100 by the pressing portions 410 of the direction controller 400. The second engaging portion 222 of the second pawl elements 220, which are not pressed by the pressing portions 410 of the direction controller 400, are pushed to protrude from the recess portions 110 of the base 100 by the reset elements 300, and the second engaging portion 222 of the second pawl elements 220 engages with the inner tooth portion 510 of the driving element 500. When the user rotates the bidirectional ratchet wrench in a clockwise direction, there is no relative movement between the second engaging portion 222 and the driving element 500. Accordingly, there is no relative movement between the driving element 500 and the base 100. The user can tighten or loosen the workpiece with the bidirectional ratchet wrench. When the user rotates the bidirectional ratchet wrench in an anticlockwise direction, the driving element 500 rotates relative to the second engaging portion 222. Accordingly, there is a relative movement between the driving element 500 and the base 100. The user cannot tighten or loosen the workpiece with the bidirectional ratchet wrench in the anticlockwise direction. As a result, it allows the user to tighten or loosen the workpiece by using a back-and-forth motion without removing the hand tool from the workpiece. Similarly, when the second engaging portion 222 of the second pawl elements 220 are pressed toward the base 100 and the first engaging portion 212 of the first pawl elements 210 are pushed to protrude from the recess portions 110 of the base 100, the user can tighten or loosen the workpiece with the bidirectional ratchet wrench in the anticlockwise direction. As a result, the bidirectional ratchet wrench is featured with bidirectional ratchet function.

Figure 5:
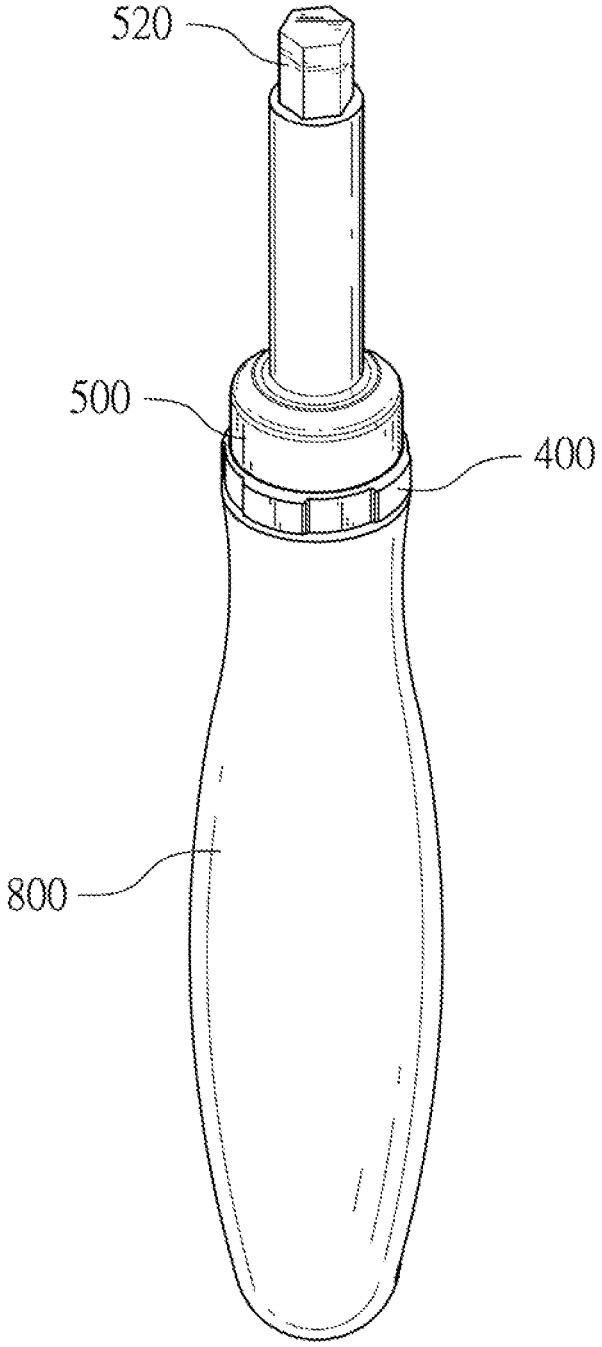
FIG. 5 is a three dimensional view of a bidirectional ratchet wrench according to another embodiment of the present disclosure.

FIG. 5 is a three dimensional view of a bidirectional ratchet wrench according to another embodiment of the present disclosure. In FIG. 5, the handle 800 is formed in a cylindrical shape. The driving element 500 can further includes a driving head 520 disposed at an end of the driving element 500, and the driving head 520 is a hex wrench head. The driving head 520 can also be a square wrench head, a socket wrench head or an adapter head for wrenches. The driving head 520 can also be formed in other kinds of shape so as to satisfy the actual needs.

Please refer to FIG. 1 to FIG. 4, a method for changing a direction of the aforementioned bidirectional ratchet structure 101 includes steps as follows. The first pawl elements 210 and the second pawl elements 220 are disposed pivotally at the base 100. Each of the first pawl elements 210 and the second pawl elements 220 is provided with a reset force for protruding from the base 100. The first pawl elements 210 are pressed toward the base 100. The second pawl elements 220 are pushed to protrude from the base 100 via the reset force. The inner tooth portion 510 of the driving element 500 engages with the second pawl elements 220 so as to make the driving element 500 rotate unidirectionally.

According to the aforementioned description, the bidirectional ratchet structure has advantages as follows. First, the bidirectional ratchet structure is stable. A force bore by the bidirectional ratchet structure can be distributed to the plurality of the first pawl elements and the plurality of the second pawl elements, so that the bidirectional ratchet structure is stable. Furthermore, the direction controller and the base have larger mounting surfaces than a conventional bidirectional ratchet structure, so that the direction controller can be mounted on the base more steadily. Second, a direction of the bidirectional ratchet structure can be changed stably. The direction of the bidirectional ratchet structure can be changed by rotating the direction controller. A force generated during the direction changing process can be distributed to the plurality of the first pawl elements and the plurality of the second pawl elements via the direction controller. The uniformly arrangement of the first pawl elements and the second pawl elements can further enhance the stability of the direction changing process. Third, the direction of the bidirectional ratchet structure can be changed easily. The direction of the bidirectional ratchet structure can be changed by rotating the direction controller. The base is surrounded by the direction controller. That means the direction controller provides a larger arm than a conventional bidirectional ratchet structure. Furthermore, a direction controller of a conventional bidirectional ratchet structure usually formed in a little button provides a small operation area, while the direction controller according to the prevent disclosure provides a larger operation area, which enhances the operation convenience.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A bidirectional ratchet structure, comprising:

a base;

a first pawl element comprising a first engaging portion, wherein the first pawl element is pivotally disposed at the base;

a second pawl element comprising a second engaging portion, wherein the second pawl element is pivotally disposed at the base, and the first engaging portion of the first pawl element and the second engaging portion of the second pawl element are pushed to protrude from the base alternatively;

two reset elements, wherein one of the reset elements disposed between the base and the first pawl element is for pushing the first engaging portion of the first pawl element to protrude from the base, and the other one of the reset elements disposed between the base and the second pawl element is for pushing the second engaging portion of the second pawl element to protrude from the base;

a direction controller pivotally and coaxially disposed at the base, wherein the first pawl element and the second pawl element are surrounded by the direction controller, and the direction controller comprises a pressing portion inwardly protruded from the direction controller to contact with the first engaging portion or the second engaging portion to prevent the first engaging portion or the second engaging portion from being protruded from the base; and a driving element pivotally and coaxially disposed at the base, wherein the first pawl element and the second pawl element are rotatably surrounded by the driving element, the driving element comprises an inner tooth portion, and the inner tooth portion engages with the first engaging portion of the first pawl element or the second engaging portion of the second pawl element which is pushed to protrude from the base;

wherein the direction controller comprises an annular portion having an inner surface, a top, a bottom and a rim portion which extends radially inwardly from the inner surface of the annular portion at a location between the top and the bottom of the annular portion;

wherein the rim portion of the direction controller has a top surface which contacts the driving element, a bottom surface which contacts the base, and an innermost surface which defines the pressing portion.

2. The bidirectional ratchet structure of claim 1, wherein the base comprises two recess portions, the first pawl element and one of the reset elements are accommodated in one of the recess portions, and the second pawl element and the other one of the reset elements are accommodated in the other one of the recess portions.

3. The bidirectional ratchet structure of claim 1, further comprising:

a pivoting element pivotally and coaxially connecting the base and the driving element.

4. The bidirectional ratchet structure of claim 1, wherein the inner surface of the annular portion above the rim portion surrounds a bottom section of an outer surface of the driving element, and the inner surface of the annular portion below the rim portion surrounds a top section of an outer surface of the base.

5. The bidirectional ratchet structure of claim 4, wherein the base comprises a first position portion, and an elastic element and an engaging element accommodated in the first position portion, and the direction controller comprises a second position portion formed as a groove along the inner surface of the annular portion below the rim portion, wherein the engaging element is pushed by the elastic element to press against the second position portion.

6. The bidirectional ratchet structure of claim 5, wherein the inner surface of the annular portion below the rim portion and outside of the second position portion tightly contacts the outer surface of the base so that no gaps are formed therebetween.

7. A bidirectional ratchet wrench, comprising:

a handle for being held by a user, and a bidirectional ratchet structure, comprising:

a base connected with the handle;

a first pawl element comprising a first engaging portion, wherein the first pawl element is pivotally disposed at the base;

a second pawl element comprising a second engaging portion, wherein the second pawl element is pivotally disposed at the base, and the first engaging portion of the first pawl element and the second engaging portion of the second pawl element are pushed to protrude from the base alternatively;

two reset elements, wherein one of the reset elements disposed between the base and the first pawl element is for pushing the first engaging portion of the first pawl element to protrude from the base, and the other one of the reset elements disposed between the base and the second pawl element is for pushing the second engaging portion of the second pawl element to protrude from the base;

a direction controller pivotally and coaxially disposed at the base, wherein the first pawl element and the second pawl element are surrounded by the direction controller, and the direction controller comprises a pressing portion inwardly protruded from the direction controller to contact with the first engaging portion or the second engaging portion to prevent the first engaging portion or the second engaging portion from being protruded from the base; and a driving element pivotally and coaxially disposed at the base, wherein the first pawl element and the second pawl element are rotatably surrounded by the driving element, the driving element comprises an inner tooth portion, and the inner tooth portion engages with the first engaging portion of the first pawl element or the second engaging portion of the second pawl element which is pushed to protrude from the base;

wherein the direction controller comprises an annular portion having an inner surface, a top, a bottom and a rim portion which extends radially inwardly from the inner surface of the annular portion at a location between the top and the bottom of the annular portion;

wherein the rim portion of the direction controller has a top surface which contacts the driving element, a bottom surface which contacts the base, and an innermost surface which defines the pressing portion.

8. The bidirectional ratchet wrench of claim 7, wherein the base is fixedly connected with the handle.

9. The bidirectional ratchet wrench of claim 7, wherein the driving element further comprises a driving head disposed at an end of the driving element, and the driving head is a square wrench head, a hex wrench head, a socket wrench head or an adapter head for wrenches.

10. The bidirectional ratchet wrench of claim 7, wherein the base comprises two recess portions, the first pawl element and one of the reset elements are accommodated in one of the recess portions, and the second pawl element and the other one of the reset elements are accommodated in the other one of the recess portions.

11. The bidirectional ratchet wrench of claim 7, further comprising:

a pivoting element pivotally and coaxially connecting the base and the driving element.

12. The bidirectional ratchet wrench of claim 7, further comprising:

a gasket disposed between the base and the driving element.

13. The bidirectional ratchet wrench of claim 7, wherein the inner surface of the annular portion above the rim portion surrounds a bottom section of an outer surface of the driving element, and the inner surface of the annular portion below the rim portion surrounds a top section of an outer surface of the base.

14. The bidirectional ratchet wrench of claim 13, wherein the base comprises a first position portion, and an elastic element and an engaging element accommodated in the first position portion, and the direction controller comprises a second position portion formed as a groove along the inner surface of the annular portion below the rim portion, wherein the engaging element is pushed by the elastic element to press against the second position portion.

15. The bidirectional ratchet wrench of claim 14, wherein the inner surface of the annular portion below the rim portion and outside of the second position portion tightly contacts the outer surface of the base so that no gaps are formed therebetween.

16. A method for changing a direction of the bidirectional ratchet structure of claim 1, the method comprising:

providing a bidirectional ratchet structure comprising a base, a first pawl element, a second pawl element and a driving element, wherein the driving element is pivotally and coaxially disposed at the base, the first pawl element and the second pawl element are rotatably surrounded by the driving element, the driving element comprises an inner tooth portion, and the inner tooth portion engages with the first pawl element or the second pawl element which is pushed to protrude from the base;

disposing the first pawl element and the second pawl element pivotally at the base, wherein each of the first pawl element and the second pawl element is provided with a reset force for protruding from the base;

pressing the first pawl element toward the base;

pushing the second pawl element to protrude from the base via the reset force; and engaging the inner tooth portion of the driving element with the second pawl element so as to make the driving element rotate unidirectionally.

* * * * *